US008720092B2

(12) United States Patent
Gussalli Beretta et al.

(10) Patent No.: US 8,720,092 B2
(45) Date of Patent: May 13, 2014

(54) ELECTRONIC DEVICE FOR A FIREARM

(75) Inventors: Franco Gussalli Beretta, Brescia (IT); Marco Bassoli, Brescia (IT); Sergio Bonomi, Brescia (IT)

(73) Assignee: Fabbrica d'Armi Pietero Beretta S.p.A., Gardone Val Trompia, Brescia (IT)

( * ) Notice: Subject to any disclaimer, the term of this patent is extended or adjusted under 35 U.S.C. 154(b) by 0 days.

(21) Appl. No.: 12/936,635

(22) PCT Filed: Apr. 20, 2009

(86) PCT No.: PCT/IT2009/000176
§ 371 (c)(1),
(2), (4) Date: Nov. 24, 2010

(87) PCT Pub. No.: WO2009/130732
PCT Pub. Date: Oct. 29, 2009

(65) Prior Publication Data

US 2011/0119979 A1 May 26, 2011

(30) Foreign Application Priority Data

Apr. 21, 2008 (IT) ..... MI2008A0720

(51) Int. Cl.
*F41A 9/62* (2006.01)

(52) U.S. Cl.
USPC ..... 42/1.02; 42/1.03

(58) Field of Classification Search
USPC ..... 42/1.01–1.05, 71.02
See application file for complete search history.

(56) References Cited

U.S. PATENT DOCUMENTS

| | | | | |
|---|---|---|---|---|
| 4,488,370 | A * | 12/1984 | Lemelson | 42/70.01 |
| 5,566,486 | A | 10/1996 | Brinkley | |
| 5,642,581 | A * | 7/1997 | Herold et al. | 42/1.02 |
| 6,226,913 | B1 * | 5/2001 | Haimovich et al. | 42/1.01 |
| 6,438,887 | B1 * | 8/2002 | Martin | 42/70.11 |
| 6,823,621 | B2 * | 11/2004 | Gotfried | 42/70.06 |
| 6,941,693 | B2 * | 9/2005 | Rice et al. | 42/71.01 |
| 7,506,469 | B2 * | 3/2009 | Poulin et al. | 42/71.02 |
| 2002/0032976 | A1 * | 3/2002 | Riener | 42/70.11 |
| 2002/0174588 | A1 * | 11/2002 | Danner et al. | 42/70.09 |
| 2004/0099134 | A1 * | 5/2004 | Gotfried | 89/1.11 |
| 2006/0042142 | A1 * | 3/2006 | Sinha | 42/1.01 |

FOREIGN PATENT DOCUMENTS

| | | |
|---|---|---|
| EP | 1881292 | 1/2008 |
| WO | 2006/085945 | 8/2006 |
| WO | 2008/048116 | 4/2008 |

* cited by examiner

*Primary Examiner* — Samir Abdosh
(74) *Attorney, Agent, or Firm* — Shoemaker and Mattare

(57) ABSTRACT

The invention relates to a an electronic device for the location of a firearm, comprising a processing module, a storage module operatively associated with the processing module, a detection module of a shot fired from a firearm operatively associated with the processing module, a transmit/receive module, operatively associated to the processing module, to allow the processing module to transmit/receive information representative of the electronic device position. The processing module results configured to transmit information representative of a shot fired from the firearm by means of the transmit/receive module.

36 Claims, 3 Drawing Sheets

ELECTRONIC DEVICE FOR A FIREARM

FIELD OF THE INVENTION

The present invention is related to an electronic device for a firearm, particularly, an electronic location device for firearms.

SUMMARY OF THE INVENTION

In order to increase the reliability of the firearms available to law enforcement officers and security staff, to increase citizens' and armed staff's security level and to manage the logistics of gun equipment, a need is currently felt to be capable of getting information related to the activity and behavior of the armed staff during working hours, by means of monitoring devices.

An object of the present invention is to conceive and provide an electronic device for a firearm suitable to supply information on the armed staff activity in a reliable manner, and which is practical to use and easy to install on a firearm.

This object is achieved by means of an electronic device for the location of a firearm, comprising:

a processing module;

a storage module operatively associated with the processing module;

a detection module of a shot fired from a firearm operatively associated with the processing module, a transmit/receive module, operatively associated with the processing module, to allow the processing module to transmit/receive information representative of the position of the electronic device, wherein the processing module results configured to transmit by means of the transmit/receive module information representative of a shot fired from the firearm.

DESCRIPTION OF PREFERRED EMBODIMENTS

Figure 1:
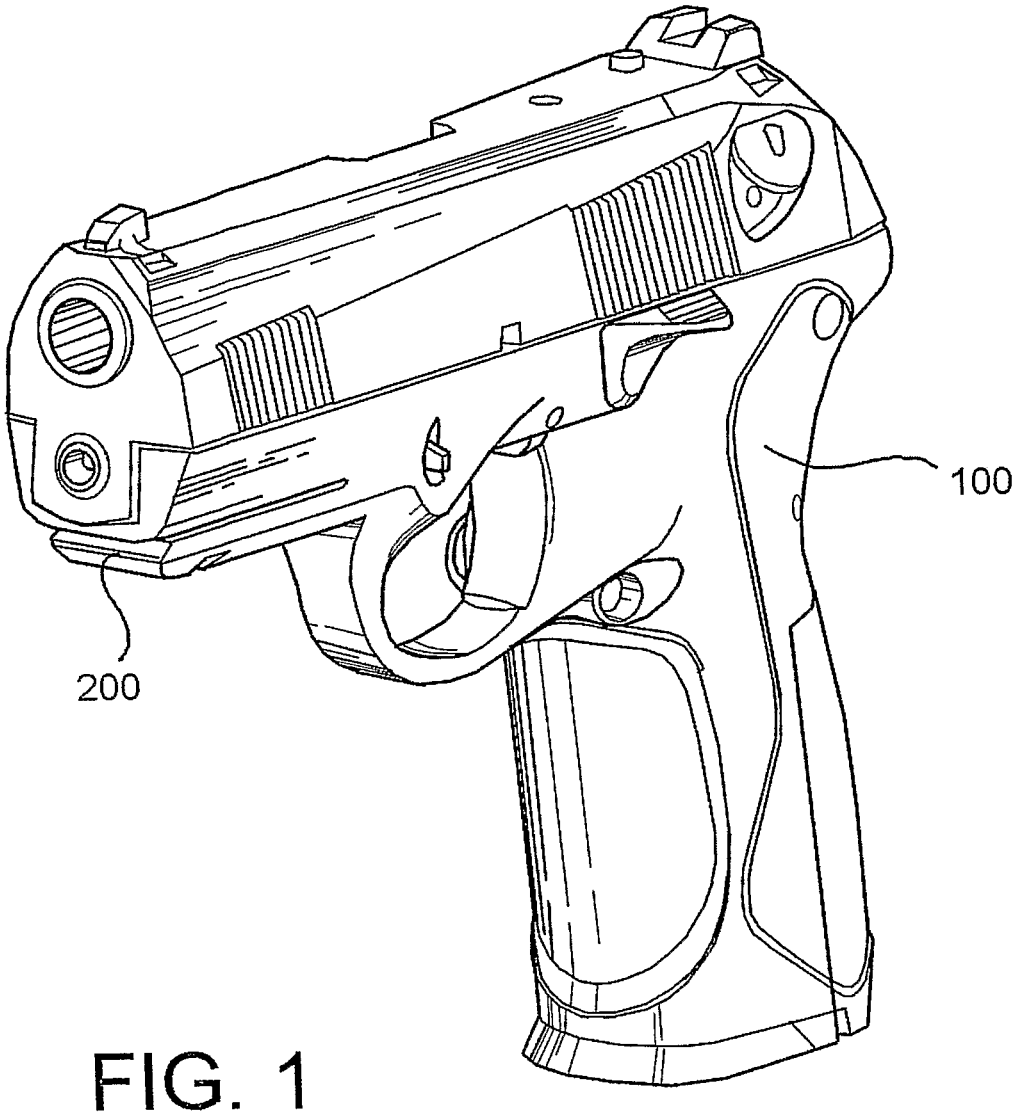
FIG. 1 illustrates a perspective view of a conventional firearm.

For purposes of the description herein, by "firearm" is meant, for example, a carbine, a rifle, a gun, such as that illustrated in FIG. 1 and generally designated with numeral 100, or a grenade launcher.

Figure 3:
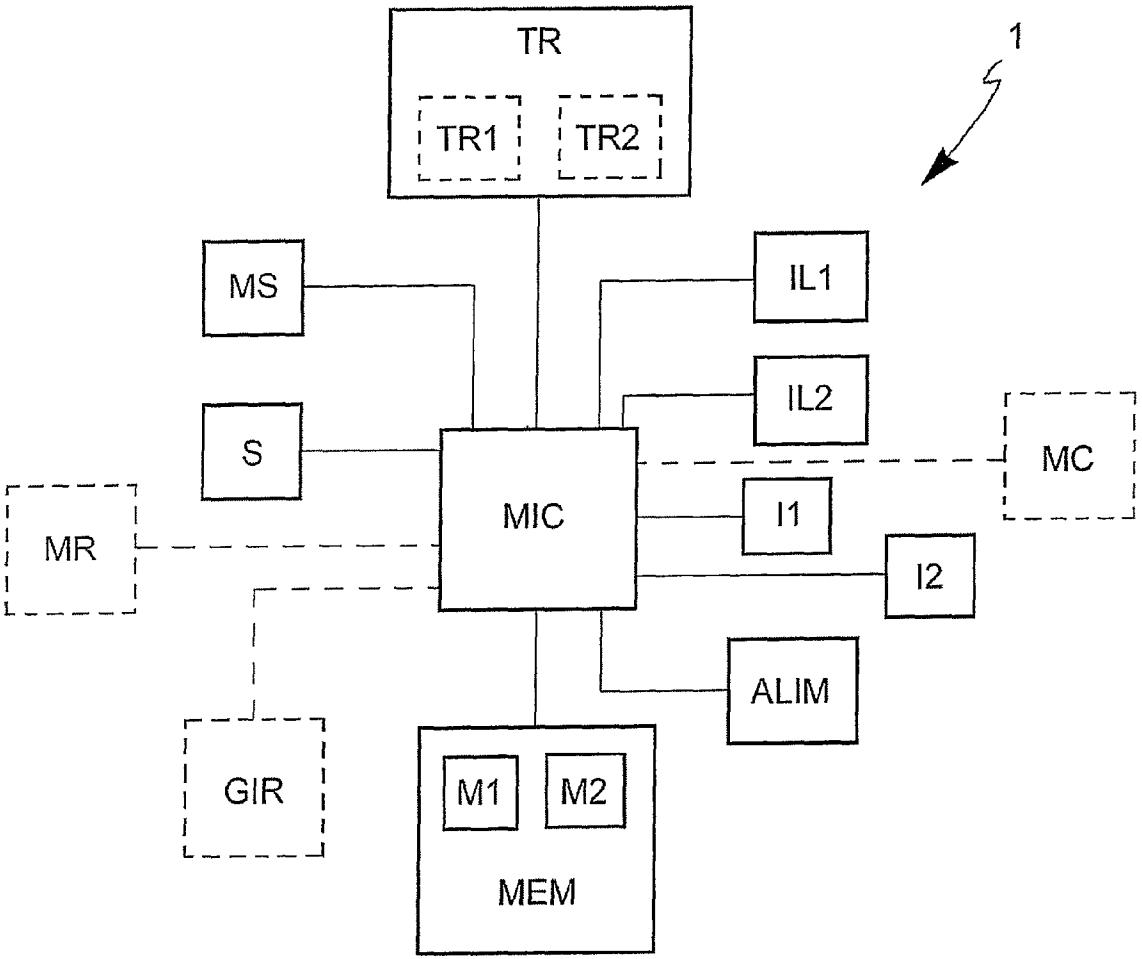
FIG. 3 schematically shows a device according to the invention.

With reference to the block diagram in FIG. 3, an electronic device will be now illustrated, which is designated with numeral 1, according to an embodiment of the invention.

The electronic device 1 comprises a processing module MIC, e.g. a microprocessor or a Central Processing Unit.

The electronic device 1 further comprises a storage module MEM operatively associated with the processing module MIC.

Preferably, the storage module MEM comprises a first memory M1 of the Random Access Memory type to load one or more processing programs executable by the processing module MIC and to store the data processed by the processing module MIC. The storage module MEM further comprises a second memory M2 of the Read Only Memory type to store further data and identity information, for example, of the electronic device 1. In the second memory M2 an electronic device identification code and an identification code of the firearm with which the electronic device will be associated (for example, the firearm serial number) can be stored.

The electronic device 1 further comprises a detection module S, which is operatively associated to the processing module MIC, to generate an electric signal representative of a mechanical stress which the electronic device may experience each time the firearm is fired. This detection module S is preferably embodied by an acceleration sensor, known per se. The processing module MIC is arranged to receive the electric signal generated by the detection module S and compare the intensity and frequency of the electric signal to the reference values stored in the storage module MEM representative of at least two different stress causes acting on the electronic device such as an actual shot (a fired shot) and a false shot (an involuntary shot, due to fall, impact or handling of the firearm). Particularly, the processing module MIC is arranged to generate and store in the storage module MEM only one piece of information representative of a fired shot and no information representative of false shots.

In accordance with a further embodiment, the detection module S can comprise an acceleration sensor calibrated such as to supply the processing module MIC only with the highest intensity electric signals at a preset calibration value of the sensor. The preset calibration value is selected such that all the electric signals generated by the sensor are representative of fired shots. Also in this case, the processing module MIC results to be configured to generate and store within the storage module MEM the information representative of a shot fired from the firearm.

It should be observed that, advantageously, the processing module is such as to store in the storage module MEM also information indicative of a progressive number of the shot fired as detected by the detection module S and to transmit this information to a Central Office.

For the purposes herein, by "Central Office" is meant a data collection center provided with processing means (for example, at least one electronic processor) arranged to receive and store in one or more databases the data supplied from the electronic device and relating the electronic device or firearm with which the electronic device is associated. A function of the Central Office processing means is of supplying the electronic device (and firearm) being monitored, based on the received data, with warnings or messages intended for the firearm owner. Several examples of these warnings or messages will be described below. A few examples of Central Office may be a monitoring centre of a night security company, a police station or a Carabinieri station.

In accordance with different embodiments of the invention, communication modes between the electronic device 1 and Central Office will be described herein below.

It should be noted that the electronic device 1, based on the information representative of the progressive number of fired shots as sent to the Central Office, is arranged to receive from the Central Office a call for maintenance after a preset number of fired shots has been reached. This call may be embodied, for example, with the lighting-up by the processing module MIC of a first pilot light IL1 (preferably, a LED diode) with which the electronic device 1 may be provided, which is suitable to warn the user that the firearm requires maintenance servicing.

Referring back to the processing module MIC, it should be observed that, preferably, it further provides a clock module suitable to supply the processing module with a clock signal and information such as date and time.

It should be noted that, advantageously, the processing module MIC results to be arranged to associate the information representative of a fired shot with the date and time at which the shot has been fired. The processing module MIC is suitable to store this information in the storage module MEM.

Referring back to FIG. 3, the electronic device 1 further comprises a transmit/receive module TR, operatively associated to the processing module MIC, to allow the processing module MIC to transmit and receive information representative of the electronic device with the Central Office.

The processing module MIC results advantageously configured to transmit by means of the transmit/receive module TR the information representative of a shot fired from the firearm.

It should be observed that, preferably, the information representative of a shot fired from the firearm comprises, as stated above, the firing date and time.

Furthermore, as will be described below in accordance with different embodiments of the invention, the processing module MIC results to be configured to generate and store in the storage module MEM the information representative of a shot fired from the firearm (comprising firing date and time) by associating this information with an information representative of the position of the electronic device 1 (and thus also of the firearm) at the firing time.

On the other hand, as will be described herein below with reference to other embodiments, the Central Office results to be configured to associate the information representative of the position of the electronic device 1, as received from the electronic device, with information representative of a fired shot (complete with date and time).

With reference to the block diagram in FIG. 3, in a first embodiment the transmit/receive module TR comprises, for example, a GSM (Global System for Mobile Communications) allowing communication between the electronic device 1 and the Central Office by means of a GSM cellular system.

Alternatively, the transmit/receive module TR can comprise a third-generation communication device, for example an Universal Mobile Telecommunications System (UMTS) device or a High Speed Data Packet Access (HSDPA) device.

Referring back to the GSM configuration, according to a first exemplary embodiment, the processing module MIC is arranged to supply the Central Office with information representative of an identification code of the electronic device 1. The Central Office is suitable to associate the position of the GSM network radio base station to which the electronic device 1 results to be connected with the identification code received in order to generate information representative of the position of the electronic device 1 and allow the latter to be located by the Central Office. It should be noted that the GSM cellular system, as is the case with mobile telephony, in which a mutual exchange of identification information takes place between the electronic device 1 and Central Office, by means of the radio base station associated with the GSM cell in which the electronic device 1 is located each time, allows the Central Office to locate the position of the electronic device 1 within the territory in real time.

In the case where the Central Office receives the information representative of the position of the electronic device 1 from at least three radio base stations (representative, for example, of three GSM cells adjacent to each other), the Central Office is prepared to calculate the position of the electronic device 1 through operations of mathematical triangulation based on information representative of the position of the GSM cells corresponding, respectively, to each of the radio base stations that have supplied the various information representative of the position of the electronic device 1 and based on the distance of the electronic device 1 from each of the radio base stations. For example, the mathematical triangulation is obtained by the Central Office by implementing suitable software adapted to process the coordinate information received.

In the exemplary embodiment described herein, the location technique is based on the cellular network (known to those skilled in the art with the name of Network-based technique), i.e. it is the network which, through the radio base stations, supplies the Central Office with the position identification information of electronic device 1.

In a further embodiment, the location of the electronic device 1 can be carried out by the electronic device 1 (this location technique is known to those skilled in the art as the Handset-based technique). In this latter case, the processing module MIC of the electronic device 1 results to be configured to acquire information representative of the position of several radio base stations to which the electronic device 1 is connected. This electronic device 1 is configured to calculate the position thereof by means of operations of mathematical triangulation based on information representative of the position of the radio base stations and based on the distance of the electronic device 1 from each of them, for example by implementing software which are entirely similar to those implemented by the Central Office. Also in this case, the electronic device 1 results to be arranged to store in the storage module MEM a data value corresponding to the calculated position. Also in this case, the electronic device 1 can be arranged to supply the Central Office with the information relating to the calculated position, corresponding to the location of the electronic device 1.

With further reference to the type of cellular network, it should be observed that, advantageously, the electronic device 1 configured to operate in a third-generation cellular network (UMTS or HSPDA) allows obtaining an even greater precision than the GSM cellular network. In fact, as known to those skilled in the art, at each operating moment, the electronic device 1 is such as to simultaneously exchange signal and control information with three adjacent radio base stations in the third-generation cellular network.

In a further embodiment, the electronic device 1 can comprise a satellite device, e.g. Global Positioning System to acquire information on the position of the electronic device 1, for example in terms of geographical coordinates (latitude and longitude). In this latter case, the processing module MIC is configured to process the information representative of the geographical coordinates received to determine the position of the electronic device 1. Also in this case, the electronic device 1 results to be arranged to store a data value in the storage module MEM corresponding to the calculated position and to supply this information to the Central Office by means of the transmit/receive module TR.

In a further embodiment of the invention, the electronic device 1 can be arranged to operate in a so-called hybrid mode, i.e. by integrating the GPS location technique with the cellular communication standard, such as GSM, UMTS or HSPDA. In greater detail, the electronic device 1 is such as to receive the location information both from the satellite system and cellular network. The processing module MIC configured to process the information received (comprising the distance of the electronic device 1 from each of the radio base stations in the cellular line to which it results to be connected) by means of operations of mathematical triangulation based on the information received in order to determine the location of the electronic device 1 with a greater degree of precision than, for example, the technique based only on a cellular network.

In accordance with another exemplary embodiment, the transmit/receive module TR can comprise a Bluetooth device to permit Bluetooth mode communication between the electronic device 1 and a Bluetooth device having the function of an access node to a traditional landline communication network to which the Central Office has also access. In this configuration, it should be observed that the processing module MIC is arranged to supply the Central Office with the information representative of the identification code of the electronic device 1. As relates the information representative of the position of the electronic device 1, the Central Office is suitable to associate the identification code received, this being the information representative of the electronic device position, with the access node position (obtainable, for example, from the IP address thereof) by which the electronic device 1 has established the Bluetooth wireless communication.

In case the Central Office receives information representative of the electronic device 1 from more than one access terminal, the Central Office is configured to select, preferably, the first information received in order of time or the one with the most powerful electric signal and associate the electronic device 1 with the position of the selected access terminal. Alternatively, and to improve the precision of the location of the electronic device 1, the Central Office can be advantageously arranged to calculate the position of the electronic device 1 through operations of mathematical triangulation based on information representative of the position of each Bluetooth terminal by which the electronic device 1 has been capable of establishing a Bluetooth communication and based on the distance of the electronic device 1 from each of the above-the Bluetooth terminals.

Alternatively, according to another embodiment, the storage module MEM of the electronic device 1 can be arranged to store a mapping of the Bluetooth devices having the function of access nodes to the landline WAN network. Accordingly, the processing module MIC results to be configured to generate information representative of the position of the Bluetooth devices with which the electronic device 1 has established the communication. Based on this information and the distance of the electronic device 1 from each of the above-the Bluetooth devices, the electronic device 1 results to be arranged to calculate the position thereof by means of operations of mathematical triangulation, for example by implementing software entirely similar to those implemented by the Central Office. Additionally, the electronic device 1 results to be configured to store in the storage module MEM a data value corresponding to the calculated position and to supply the Central Office with this information.

According to another embodiment, the transmit/receive module TR can comprise a Wi-Fi antenna to be capable of communicating in wireless mode with an access terminal to a landline communication network to which the Central Office is connected. In this configuration, as relates the information representative of the position of the electronic device 1, the Central Office is suitable to associate the identification code received from electronic device 1, this being information representative of the position of the electronic device, with the position of the access terminal (obtainable, for example, from the IP address thereof) with which the electronic device 1 has established the wireless communication in Wi-Fi mode.

In case the Central Office receives information representative of the electronic device 1 from more than one access terminal, the Central Office is configured to select, preferably, the first information received in order of time or the one with the most powerful electric signal and associating the electronic device 1 with the position of the selected access terminal. Alternatively, and in order to improve the precision of location of the electronic device 1, the Central Office can be preferably arranged to calculate the position of the electronic device 1 by means of operations of mathematical triangulation based on information representative of the position of each of the access terminals to the land network with which the electronic device 1 has established the communication in Wi-Fi mode and based on the distance of the electronic device 1 from each of the access terminals.

Alternatively, according to another embodiment, the storage module MEM of the electronic device 1 can be arranged to store a mapping of the access terminals to the landline communication network. Accordingly, the processing module MIC results to be configured to generate information representative of the position of the access terminals with which the electronic device 1 has established the communication in Wi-Fi mode. Based on this information and the distance of the electronic device 1 from each of the above-the access terminals, the electronic device 1 results to be arranged to calculate by means of operations of mathematical triangulation the position thereof, for example by implementing software entirely similar to those implemented by the Central Office. Additionally, the electronic device 1 results to be configured to store in the storage module MEM a data value corresponding to the calculated position and to supply the Central Office with this information.

In a further embodiment, the transmit/receive module TR can comprise a first communication module TR1 (shown in dotted lines in FIG. 3) intended to handle the information representative of the position of the electronic device 1. The transmit/receive module TR can further comprise a second communication module TR2 (also shown in dotted lines in FIG. 3) of information representative, for example, of a shot fired from the firearm, alarm signal or a device-uncoupled-from-firearm signal (some of these aspects will be described in greater detail herein below), associating this information with the position of the electronic device 1 supplied from the first communication module TR1.

In a further embodiment, the first communication module TR1 can be arranged only to receive, for example from a satellite system, information representative of the position of the electronic device 1, whereas the second communication module TR2 can be arranged to send, for example by means of a cellular network, the information representative of the position of the electronic device 1 and the information concerning the above-mentioned signals to the Central Office.

It should be noted that, advantageously, the processing module MIC is arranged to associate the information related to the detection of a fired shot with the date and time at which the shot has been fired. The processing module MIC is suitable to store this information in the storage module MEM by associating the same to the received information related to its position and transmit the latter to the Central Office by means of the transmit/receive module TR.

In accordance with a further embodiment, the processing module MIC can be advantageously arranged to store in the storage module MEM and transmit to a further database of the Central Office, for example public safety records, information indicative of the passage of the electronic device at an entrance of a warehouse place (for example, an armory) where the firearm is stored. Thereby, by generating information representative of the firearm exiting the place and information representative of the firearm entering the place, the Central Office can monitor further logistic movements of a firearm, such as, indeed, the latter entering or exiting a warehouse place.

Figure 4:
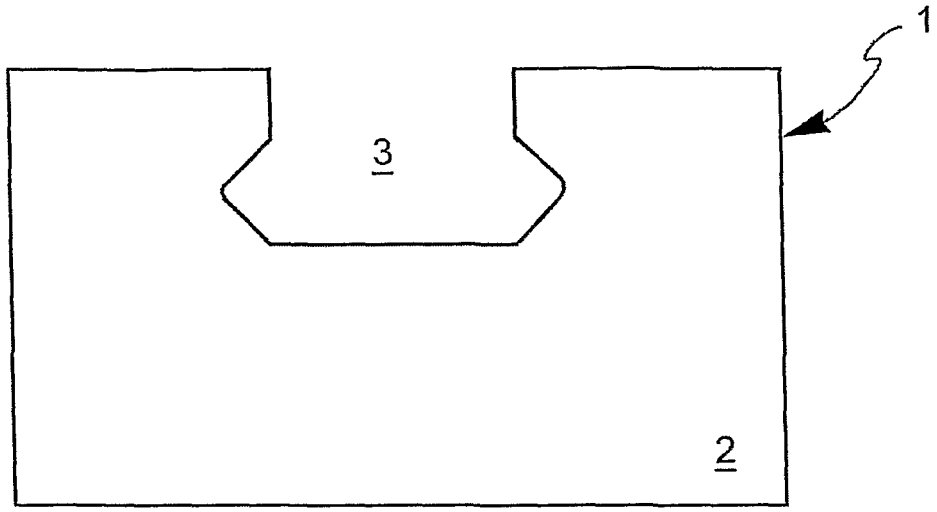
FIG. 4 illustrates a sectional view of a device according to an exemplary embodiment of the invention.

With reference to FIG. 4, the electronic device 1 described herein results to be advantageously accommodated within a small sized container 2. An exemplary size of the container is: about 30 mm max width, about 40 mm max length, about 30 mm max height.

Figure 2:
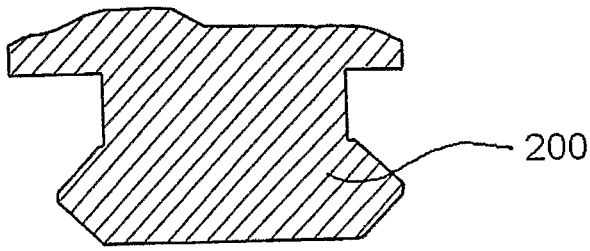
FIG. 2 illustrates a sectional view of a detail of the firearm in FIG. 1.

The firearm 100, of a known type, can be provided with a Picatinny rail 200, known per se, for slidably coupling an accessory device (not shown in FIG. 1) to the firearm, which is suitably provided with a profile groove matching the section profile of the Picatinny rail 200. An exemplary accessory device can be a lighting torch or a laser pointing device. In FIG. 2 is depicted the sectional view of the rail 200 of the firearm 100.

The container 2 results to be advantageously provided with a groove 3 having a matching profile relative to the Picatinny rail 200 of the firearm 100 in FIG. 1 to allow the electronic device 1 to be slidably coupled to the firearm 100, if the latter is provided therewith. The groove 3 represents an example of means for slidably coupling the electronic device 1 to the firearm.

In accordance with an embodiment, the container 2 of the electronic device 1 further comprises stop means (not shown in FIG. 3) which are associated with the groove 3 and arranged to abut against respective seats defined on the rail 200. The abutment of the stop elements within the seats defined on the rail are such as to allow the container 2 to be locked to the gun 100 after the groove 3 have been completely inserted within the rail 200. Particularly, the removal of the container 2 from the gun 100 can be manually carried out on the stop elements such as to release the grip on the rail and facilitate the sliding removal of the electronic device from the gun.

Figure 5:
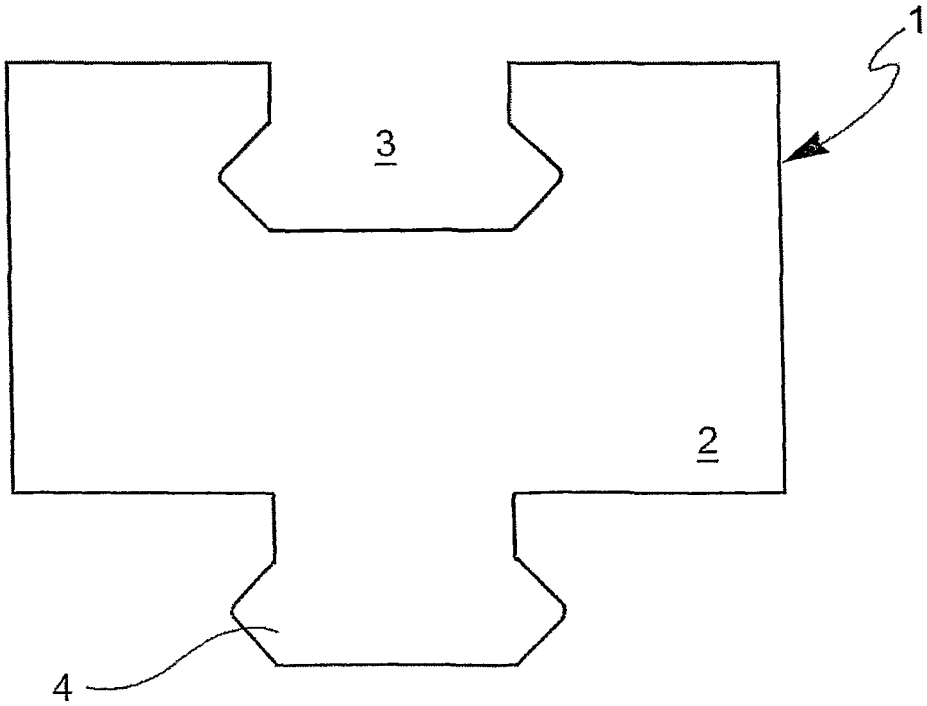
FIG. 5 illustrates a sectional view of a device according to a further embodiment of the invention.

With reference now to FIG. 5, in a further embodiment of the electronic device of the invention, the container 2 comprises, on a face opposite the one provided with the groove 3, a further Picatinny rail 4 entirely similar to the rail 200 with which is provided the gun 100 shown in FIG. 1.

This further embodiment advantageously allows mounting further accessory devices (not shown in FIG. 5) such as, for example, a lighting torch or a laser pointing device to the electronic device 1 assembled to the gun 100.

With reference to the exemplary embodiments described in accordance with FIGS. 4 and 5, it should be observed that, advantageously, the electronic device 1 further comprises means (not shown in the figures) for enabling the removal of the electronic device from the gun. This enabling means are embodied by mechanical means capable of allowing the loosening of the stop elements only when a key is used or an identification code is entered (for example, a combination) by the firearm user. In a further embodiment the electronic device 1 can be arranged to allow loosening the stop elements by means of the firearm user's fingerprint recognition.

In accordance with an embodiment, the loosening of the stop means can be obtained by the user by sending a special command by means of a portable device communicating with the electronic device 1 in one of the wireless modes described above.

The various modes for loosening the stop means described above advantageously allow preventing any forced removal of the electronic device by unauthorized persons.

In accordance with a particular embodiment, with further reference to FIG. 3, the electronic device 1 further comprises a signal module MS, operatively associated with the processing module MIC, which is suitable to provide information representative of the uncoupling of the electronic device from the gun. For the purposes herein, by "uncoupling" is meant both the voluntary disassembly by the firearm owner (for example for maintenance or battery recharge purposes) and the forced uncoupling by unauthorized persons and the uncoupling following an impact or accidental fall of the gun together with the electronic device associated therewith. Particularly, it should be noted that, advantageously, the processing module MIC is configured such as to transmit the information representative of the uncoupling of the electronic device from the firearm to the Central Office by means of the transmit/receive module TR. In case the transmission is not available, the processing module is suitable to store this uncoupling information in the storage module MEM to transmit the latter to the Central Office when transmission will be restored. The processing module MIC can be also arranged to associate the uncoupling information also with date, time and identification code of the electronic device at the uncoupling moment.

The electronic device 1 further comprises at least one first switch I1 and one second switch I2 which are operatively associated with the processing module MIC to signal different operating conditions of the electronic device to the processing module.

Particularly, the first switch I1 is arranged to allow a user to switch the electronic device 1 from on condition to off condition, and vice versa.

In accordance with a particular embodiment, the first switch I1 results advantageously located within the groove 3 of the container 2 such as to result accessible to the user only when the electronic device 1 results to be uncoupled from the firearm. This allows avoiding that the first switch I1 is accidentally pressed when the firearm is being used and the electronic device 1 is thus turned off when it is coupled to the firearm. When the electronic device is associated with the firearm, it always results in on-condition except when it is turned off due to exhausted battery.

In a further embodiment, the first switch I1 results to be located within the groove 3 of the container 2 and has such a configuration as to determine the switching on of the electronic device 1 when the Picatinny rail of the firearm is being introduced within the groove 3 in case the electronic device 1 is still in off-condition.

As relates the second switch I2, it is arranged to allow a firearm user to command the processing module MIC sending an alarm signal to the Central Office by means of the transmit/receive module TR.

Unlike the first switch I1, the second switch I2 results to be advantageously located on the container 2 in a place accessible by the user both when the electronic device 1 results to be associated with the firearm and when the electronic device 1 results to be disassembled from the firearm.

The electronic device 1 further comprises a second pilot light IL2 (for example, a LED diode) which is operatively associated with the processing module MIC having the function of signaling the operating condition of the electronic device 1. Particularly, the pilot light results: turned off to indicate that the electronic device is off; turned on with green flashing light to indicate that the electronic device is on; turned on with red flashing light to indicate the non-possibility of communication between the electronic device 1 and the Central Office; turned on with steady red light to indicate that the battery of the electronic device requires to be charged.

It should be observed that, advantageously, the detection module S and processing module MIC are arranged to generate an electric signal representative of a shot fired from the firearm and generate and store in the storage module MEM information representative of the fired shot (complete with date, time, identification code or position of the device and orientation of the firearm at the moment of firing, if provided), respectively, also when it is not possible to communicate with the Central Office.

Additionally, the processing module MIC is arranged to count the shots fired by the firearm and store the total number of the latter in the storage module MEM also when it is not possible to communicate with the Central Office.

Still more advantageously, the signal module MS is arranged to signal to the processing module MIC that the electronic device 1 has uncoupled from the firearm and the processing module MIC is arranged to store the respective uncoupling information in the storage module MEM also when it is not possible to communicate with the Central Office.

With reference to the exemplary embodiments in FIGS. 4 and 5, it should be observed that the container 2 of the electronic device 1 has, in addition to the groove 3 (FIGS. 4 and 5) and the optional Picatinny rail 4 (FIG. 5), the second switch I2, the first pilot light IL1 suitable to signal the recall for maintenance of the firearm, the second pilot light IL2 suitable to indicate different conditions of the electronic device 1, on the outer surface thereof.

The electronic device 1 comprises electric supply means ALIM, for example a battery rechargeable by electromagnetic induction, operatively associated with the processing module MIC. It should be observed that the selection of the type of battery is the result of a good compromise aimed at ensuring an acceptable transmission signal power supply, a relatively long autonomy and quite small size. For example, the battery for use in the electronic device of the example of the invention can have a minimum autonomy of at least 150 hours.

As relates the electromagnetic induction charging of the battery, it can be carried out by placing the electronic device 1 proximate to a battery-charger suitable to allow charging the above-the battery by electromagnetic effect, which is known per se. This characteristic allows the container 2 to be free of electric contacts or electric sockets accessible from the outside which may allow an unauthorized person to connect the electronic device with another portable device to tamper with the processing module MIC or having access to the data stored in the storage module MEM. It should be noted that, advantageously, charging the battery in the above-indicated manner is allowed regardless of the electronic device 1 being assembled or disassembled relative to the firearm.

Referring back to FIG. 3, as relates the condition of the battery ALIM and the condition of the electronic device 1 following the operation of the first switch I1, the following operating conditions can be configured for the electronic device 1.

In case the electronic device 1 is in on-condition, it carries out all the functions as described above. Again, in case the connection with the Central Office is enabled, the information processed by the processing module MIC are sent by the transmit/receive module TR to the Central Office in real time. On the other hand, in case the communication with the Central Office is not possible (for example when the arm is in an underground room and the propagation of signals is not possible), the processing module MIC stores all the processed information in the storage module MEM to send them to the Central Office after the communication has been restored.

In case the electronic device 1 is turned off or has a completely exhausted battery, the electronic device 1 cannot carry out any one of the functions for which it is enabled.

In a further embodiment the electronic device 1 further comprises an orientation sensor GIR (shown in dotted lines in the figures), operatively associated with the processing module MIC, capable of detecting information representative of the triaxial orientation of the firearm. For example, the orientation sensor GIR is based on the use of sensors suitable to recognize the direction of acceleration due to gravity as experienced by the electronic device 1. The electronic device 1 is thus capable of, based on the recognized direction of acceleration due to gravity, calculating the information relating the triaxial orientation of the firearm, particularly at the moment of firing. The orientation sensor GIR can comprise, for example, one or more accelerometers and/or one or more gyroscopes manufactured, for example, in MEMS technology (Micro Electro-Mechanical Systems), known per se.

In this case, the processing module MIC is suitable to generate information representative of the fired shot, date, firing time, position of the electronic device and triaxial orientation of the firearm at the moment of firing being associated therewith.

Furthermore, in a further embodiment of the invention, the electronic device 1 comprises a further detection module MR suitable to supply a further electric signal to the microprocessing module MIC representative of the firearm being pulled out of the holster. The processing module MIC is suitable to store this information in the storage module MEM and transmit this information to the Central Office by means of the transmit/receive module TR.

Furthermore, the electronic device 1 can comprise a count module MC for the shots provided in the firearm magazine operatively connected to the processing module MIC.

It should be also observed that the electronic device 1 is advantageously arranged to communicate in wireless mode with a hand-held device for transferring electronic device programming codes or updating the data stored in the storage module MEM.

It should be observed that in a further embodiment, the electronic device can comprise a container which is not provided with a groove for slidably coupling to the firearm, in that it is manufactured as one piece with the firearm. In this case, the container can have a Picatinny rail for coupling accessory devices to the firearm, such as a lighting torch or a laser pointing device.

With reference now to a location system for a firearm, it comprises data processing means (for example a Central Office electronic processor), one or more databases (for example comprised in the Central Office) to store the data processed by the processing means, transmit/receive means operatively associated with the processing means for receiving information representative of the electronic device from an electronic device for a firearm entirely similar to that described and defined above. This system has the advantageous aspect, as stated above, that the processing means (the Central Office) result to be configured to calculate the position of the electronic device through the processing of information representative of the electronic device.

In accordance with a particular embodiment, the location system comprises processing means arranged to calculate the position of the electronic device through operations of mathematical triangulation based on at least three pieces of information representative of coordinates of space points and based on the distance of the electronic device 1 from each of the above-the space points.

As may be understood, the object of the invention is fully achieved in that, as partially stated above, the electronic device described herein has the advantage of making the use of the firearm to which the device is connected controllable and monitorable to a certain degree of reliability. The data that can be supplied to the Central Office relate the monitoring of the firearm use made by the owner thereof, i.e. the individual shots fired from the firearm, in terms of when (date and time) and how (position and location of firearm) they have been fired, and the monitoring of the firearm conditions, i.e. the total number of shot fired such as to get an indication on the firearm maintenance requirement.

Advantageously, the electronic device allows the Central Office to constantly know the position of the firearm and being thus capable of monitoring the movements of the security staff.

Furthermore, the inventive electronic device advantageously allows monitoring the firearm from a logistic point of view by recording and communicating to the Central Office that the firearm has been brought in or out an armory.

Still more advantageously, the inventive electronic device allows monitoring any uncoupling of the device from the firearm and inhibiting uncoupling by unauthorized persons. Additionally, the inventive electronic device can be used by the firearm owner to communicate an alarm to the Central Office in case a dangerous situation is occurring.

Additionally, the particular configuration of the container not being provided with any socket or outer electric contact greatly reduces the possibility of tampering by any unauthorized or ill-intentioned person and increases the reliability of the system as it has no contacts from the outside.

Additionally, the fact that the electronic device has a groove for a Picatinny rail makes the device quite advantageous in terms of coupling and uncoupling from a conventional firearm. In addition, the size and weight of the device allow a firearm equipped with the inventive electronic device to remain handy and small-sized.

The invention claimed is:

1. An electronic device for locating a firearm at a moment of firing, said device comprising:

a processing module;

a storage module operatively associated with the processing module;

a detection module for detecting a shot fired from a firearm operatively associated with the processing module, a transmit/receive module, operatively associated with the processing module, through which the processing module can transmit/receive information representative of said location of the electronic device, wherein the processing module is configured to transmit by means of the transmit/receive module information representative of a shot fired from the firearm, the detection module comprises an acceleration sensor which generates an electric signal when a mechanical stress is experienced by the electronic device, the transmit/receive module comprises a locating device to acquire information relating to the geographic coordinates of the electronic device position, and the processing module is configured to process the information representative of the received geographic coordinates to determine the electronic device position, to store in the storage module a data value corresponding to the position calculated and to supply a central office with the data value.

2. The electronic device according to claim 1, wherein the transmit/receive module comprises a cellular device arranged to establish communication in a cellular system through at least one radio base station of the cellular system.

3. The electronic device according to claim 2, wherein the electronic device is arranged to calculate its position by means of mathematical triangulation based on information representative of the position of several radio base stations with which the electronic device is associated and based on the distance of the electronic device from each of the radio base stations.

4. The electronic device according to claim 2, wherein the cellular system is of the type belonging to the group consisting Global System for Mobile Communications (GSM), Universal Mobile Telecommunications System (UMTS) and High Speed Data Packet Access (HSDPA).

5. The electronic device according to claim 1, wherein the transmit/receive module comprises a Bluetooth antenna to establish a wireless communication with at least one Bluetooth terminal operatively connected to a landline wide area network.

6. The electronic device according to claim 5, wherein the electronic device is arranged to calculate its position by means of mathematical triangulation based on information representative of the position of several Bluetooth terminals with which the electronic device establishes a communication in wireless mode and based on the distance of the electronic device from each of the Bluetooth terminals.

7. The electronic device according to claim 1, wherein the transmit/receive module comprises a Wi-Fi antenna to establish a wireless communication with at least one access terminal to a landline wide area network.

8. The electronic device according to claim 7, wherein the electronic device is arranged to calculate the position thereof by means of mathematical triangulation based on information representative of the position of several access terminals to the landline WAN network with which the electronic device establishes a communication in wireless mode and based on the distance of the electronic device from each of the access terminals.

9. The electronic device according to claim 1, wherein the transmit/receive module comprises a first communication module dedicated to handling information representative of the position of the electronic device and a second communication module for handling the information representative of a shot fired from the firearm by associating the latter to the position of the electronic device as supplied from the first communication module.

10. The electronic device according to claim 1, wherein the transmit/receive module comprises a satellite device to acquire information relating to the geographic coordinates of the electronic device position.

11. The electronic device according to claim 1, wherein the locating device is GPS.

12. The electronic device according to claim 1, wherein the processing module associates the information representative of the fired shot, date, time and position of the firearm at the moment in which the shot has been fired.

13. The electronic device according to claim 12, wherein the processing module transmits, by means of the transmit/receive module, an identification code of the electronic device and a further identification code of the firearm with which the electronic device is associated.

14. The electronic device according to claim 13, wherein the processing module is arranged to carry out a progressive count of the number of shots fired from the firearm and to transmit the shot count by means of the transmit/receive module.

15. The electronic device according to claim 14, wherein the processing module is arranged to store in the storage module information representative of the fired shot including date, firing time, and the information indicative of the number of fired shots.

16. The electronic device according to claim 15, wherein the processing module is suitable to receive from a central office, by means of the transmit/receive module, information indicative of a call for maintenance of the firearm after a preset number of shots has been fired.

17. The electronic device according to claim 16, further comprising a first pilot light operable from the processing module to warn the firearm user about the call for maintenance of the arm.

18. The electronic device according to claim 1, wherein the processing module is arranged to compare the electric signal supplied from the acceleration sensor with preset values stored in the storage module to ascertain whether the electric signal is indicative of a shot fired from the firearm.

19. The electronic device according to claim 18, wherein the acceleration sensor is calibrated to supply the processing module with an electric signal representative of a shot fired from the firearm.

20. The electronic device according to claim 1, further comprising an orientation sensor operatively associated with the processing module to supply information indicative of the triaxial orientation of the firearm at the moment of firing.

21. The electronic device according to claim 20, wherein the processing module stores the information indicative of the orientation of the firearm at the moment of firing in the storage module and transmits this information in association with the information representative of the fired shot.

22. The electronic device according to claim 1, wherein the electronic device is accommodated within a container provided with a groove such as to allow a sliding coupling with a Picatinny rail of a firearm is provided.

23. The electronic device according to claim 22, further comprising means for enabling removal of the electronic device from the firearm to allow releasing stop elements after one of the following events has occurred: a user's identification code has been entered, a key has been used, a code has been entered by means of wireless communication with a portable device, a fingerprint has been recognized.

24. An electronic device for locating a firearm at a moment of firing, said device comprising:

a processing module;

a storage module operatively associated with the processing module;

a detection module for detecting a shot fired from a firearm operatively associated with the processing module, and a transmit/receive module, operatively associated with the processing module, through which the processing module can transmit/receive information representative of the position of the electronic device, wherein the processing module is configured to transmit by means of the transmit/receive module information representative of a shot fired from the firearm, and wherein the detection module comprises an acceleration sensor which generates an electric signal when a mechanical stress is experienced by the electronic device, and further comprising a signal module for indicating when the electronic device is uncoupled from the firearm, the signal module being operatively associated with the processing module to store uncoupling information in the storage module and transmit this information by means of the transmit/receive module.

25. The electronic device according to claim 24, further comprising a first switch operatively associated with the processing module to turn the electronic device from on-condition to off-condition, and vice versa.

26. The electronic device according to claim 25, wherein the first switch is located within a groove with which a container is provided, the electronic device being accommodated therein.

27. The electronic device according to claim 25, further comprising a second switch operatively associated with the processing module to allow the firearm user to transmit an alarm signal by means of the transmit/receive module.

28. The electronic device according to claim 17, further comprising a second pilot light operatively associated with the processing module to signal the following operative conditions of the electronic device: turned-off, turned-on, no communication available, requires battery charge.

29. The electronic device according to claim 1, wherein the electronic device is arranged to communicate in wireless mode with a portable device to allow programming the electronic device.

30. The electronic device according to claim 1, further comprising a count module for counting the shots provided within a firearm magazine.

31. The electronic device according to claim 1, further comprising a further detection module operatively associated with the processing module for generating a further electric signal representative of the firearm being pulled out of the holster.

32. The electronic device according to claim 22, wherein the container is provided with a further Picatinny rail for coupling the electronic device to a further accessory device.

33. The electronic device according to claim 1, wherein the processing module is arranged to store information indicative of the passage of the firearm at an entrance of a place where the firearm is stored in the storage module and to transmit such information by means of the transmit/receive module.

34. A firearm comprising a electronic locating device according to claim 1.

35. The electronic device according to claim 34, wherein the electronic device is manufactured as one piece with the firearm.

36. The firearm according to claim 34, wherein the firearm selected from the group consisting of a gun, a carbine, a rifle, a grenade launcher.

* * * * *